US006125244A

United States Patent [19]

Kamiya

[11] Patent Number: 6,125,244

[45] **Date of Patent: *Sep. 26, 2000**

[54] IMAGE FORMING APPARATUS FEATURING AN ENVIRONMENTALLY RESPONSIVE VOLTAGE SWITCH

[75] Inventor: Yuji Kamiya, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/890,511

[22] Filed: Jul. 9, 1997

[30] Foreign Application Priority Data

Jul. 10, 1996 [JP] Japan ..... 8-181060

[51] Int. Cl.[7] ..... G03G 15/00; G03G 21/00

[52] U.S. Cl. ..... 399/44; 399/94; 399/97; 399/388

[58] Field of Search ..... 399/44, 316, 388, 399/390, 296, 99, 94, 97

[56] References Cited

U.S. PATENT DOCUMENTS

| | | | |
|---|---|---|---|
| 4,396,273 | 8/1983 | Matsuyama et al. | 399/316 |
| 4,491,407 | 1/1985 | Mitsuyama et al. | 399/316 |
| 5,379,094 | 1/1995 | Wing et al. | 399/296 X |
| 5,633,703 | 5/1997 | Takenouchi et al. | 399/44 X |
| 5,717,980 | 2/1998 | Oka et al. | 399/316 X |

FOREIGN PATENT DOCUMENTS

| | | |
|---|---|---|
| 61-32667 | 7/1986 | Japan . |
| 63-272331 | 11/1988 | Japan . |
| 4-120561 | 4/1992 | Japan . |
| 4-153671 | 5/1992 | Japan . |
| 4-58031 | 9/1992 | Japan . |
| 8-87185 | 4/1996 | Japan . |

*Primary Examiner*—Susan S. Y. Lee
*Attorney, Agent, or Firm*—Fitzpatrick, Cella, Harper & Scinto

[57] ABSTRACT

An image forming apparatus includes of an image bearing member, an image forming unit for forming a toner image onto the image bearing member, a transfer charging unit for transferring the toner image from the image bearing member to a transfer material at a transfer position, a guide member for guiding the transfer material to the transfer position, a sensor for detecting an ambient environment of the image forming apparatus, and a switch for switching whether the guide member is connected to a constant voltage element or is connected to the ground in accordance with a detection result of the sensor.

8 Claims, 6 Drawing Sheets

IMAGE FORMING APPARATUS FEATURING AN ENVIRONMENTALLY RESPONSIVE VOLTAGE SWITCH

BACKGROUND OF THE INVENTION

1. Field of the Invention

The invention relates to an image forming apparatus and, more particularly, to an image forming apparatus having a guide member for specifying a conveying path of a transfer material which is led between an image bearing member and a transfer apparatus.

2. Related Background Art

A conventional image forming apparatus has an image bearing member on which an electrostatic latent image is formed in accordance with image information, developing means for visualizing the electrostatic latent image formed on the image bearing member, and a transfer apparatus for transferring a toner image on the image bearing member onto a transfer material.

In order to transfer the toner image held on the image bearing member onto the transfer material, it is necessary to pass the transfer material between the image bearing member and the transfer apparatus at a proper timing or always at a proper insertion angle or the like. For this purpose, a guide member which is electrically connected to the ground and specifies a passage is provided for the transfer material on the upstream side relative to the image bearing member in the conveying direction of the transfer material.

However, a transfer current under an environment of a high humidity, namely, charges applied by a transfer apparatus onto the transfer material whose resistance is reduced by being subjected to a moisture flow to the guide member connected to the ground and a transfer efficiency shown by a toner amount on the transfer material to a toner amount on the image bearing member deteriorates. Therefore, a construction for charging the guide member to an electric potential having the same polarity as that of the discharge charges of the transfer current, namely, a polarity opposite to that of toner is considered. As a method for realizing such a construction, there are known the following methods such as a method shown in Japanese Patent Publication No. 61-32667 wherein a bias power source is used as a guide member; a method shown in Japanese Patent Publication No. 4-58031 wherein a varistor serving as a constant voltage element is connected to a guide member and an electric potential of the guide member is charged to about 600V by receiving a transfer current; a method wherein in order to merely obtain a guide member of an electric potential having a polarity opposite to that of toner, the guide member is set into an electrically insulating state and a voltage is stepped up by a transfer current; and the like.

Further, in order to prevent a defective transfer, there is known also a technique such that an insulating state is selected under only an environment of a high humidity and a guide member is connected to the ground under another environment.

The method of setting the electric potential of the guide member in the conventional image forming apparatus, however, has the following problems.

First, according to the method of connecting the guide member to the ground, the transfer efficiency under the high humidity environment deteriorates as mentioned above and in the connection to the ground under the high humidity environment, there is a case where the transfer efficiency is below 60%, so that it is not efficient. On the other hand, according to the method of charging the guide member to the electric potential of the polarity opposite to that of the toner in order to maintain the transfer efficiency, another problem occurs such that the transfer material becomes dirty. In other words, when the guide member is charged to the electric potential of the polarity opposite to that of the toner, an operation for electrically attracting the toner to the transfer material acts and the transfer material becomes dirty.

According to the method of connecting the varistor to the guide member and charging the electric potential of the guide member to about 600 V by receiving the transfer current, under a low humidity environment in which a charged charge amount of toner increases, an electric adsorbing force is enhanced and the toner is deposited onto the guide member, so that a problem occurs such that the toner is adhered to the transfer material and the transfer material becomes dirty.

Further, a contamination of the transfer material, namely, a contamination of the guide member is more remarkable as the electric potential to be applied to the guide member of the polarity opposite to that of the toner becomes higher. When the guide member is set into the electrically insulating state, the electric potential during the continuous copying operation reaches 1000V or higher. Even in the high humidity environment as well as such a low humidity environment, the toner is likely to be adhered to the guide member which was charged to a high voltage. Since the guide member is electrically insulated, assuming that it is charged to 1000V or more, when a problem such as a jam or the like occurs, there is a case where the user directly touches the jammed transfer material and removes it. Therefore, it is prefered.

Consequently, even if the guide member is made insulative only under the high humidity environment and is connected to the ground under another environment, the contamination of the guide member occurs under the high humidity environment. In case of switching the guide member to the insulating state in which there is no electrical connection and the state in which the guide member is connected to the ground, the charges accumulated in the insulating state are hard to escape even after the elapse of time. When the guide member is switched to the ground connecting state, a spark discharge occurs and electric noises are generated. Therefore, it is necessary to take a countermeasure against the noises for the other electric parts. A problem such as an increase in burden on costs occurs.

SUMMARY OF THE INVENTION

It is an object of the invention to provide an image forming apparatus which can prevent a contamination of a guide member without deteriorating a transfer efficiency.

Another object of the invention is to provide an image forming apparatus for setting an electric potential of a guide member to a proper value irrespective of the environment.

Still another object of the invention is to provide an image forming apparatus for properly setting an electric potential of a guide member at a low cost.

The above and other objects and features of the present invention will become apparent from the following detailed description and the appended claims with reference to the accompanying drawings.

BRIEF DESCRIPTION OF THE DRAWINGS

FIGS. 3A and 3B are explanatory diagrams each showing a locus of a transfer material which passes between the guide members, in which FIG. 3A is a diagram showing the locus of a normal sheet in a hatched region and FIG. 3B is a diagram showing the locus of a thick sheet in a hatched region;

DETAILED DESCRIPTION OF THE PREFERRED EMBODIMENTS

Embodiments of the invention will now be described in detail hereinbelow with reference to the drawings.

<First embodiment>

Figure 1:
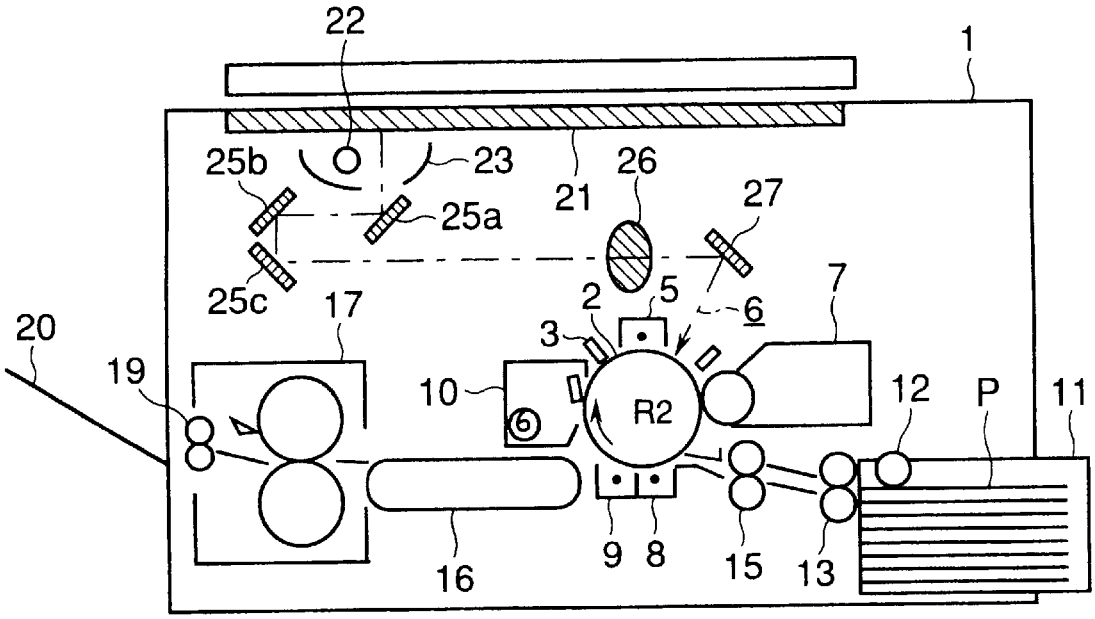
FIG. 1 is a schematic constructional diagram showing the first embodiment of an image forming apparatus according to the invention.

FIG. 1 is a schematic constructional diagram showing the first embodiment of an image forming apparatus according to the invention and will be explained with respect to a copying apparatus as an example.

In the diagram, a cylindrical electrophotographing photosensitive material (hereinafter, referred to as a "photosensitive drum") 2 serving as an image bearing member is provided at an almost center of a main body 1 of an image forming apparatus. The photosensitive drum 2 is supported by the main body 1 so as to be rotatable in the direction shown by an arrow R2. A discharging unit 3 for erasing an electric potential on the photosensitive drum 2, a primary charging unit (charging unit) 5 for uniformly charging the surface of the photosensitive drum 2, an exposing unit 6 for exposing the surface of the photosensitive drum 2 and forming an electrostatic latent image, a developing unit (visualizing unit) 7 for adhering toner onto the electrostatic latent image and forming a toner image, a transfer charging unit (transfer charging means) 8 for transferring the toner image onto a transfer sheet P serving as a transfer material for receiving a transfer of the toner image, a separation charging unit (separating unit) 9 for discharging the transfer sheet and separating the transfer sheet P from the photosensitive drum 2; a cleaning unit 10 for removing the residual toner on the photosensitive drum 2, and the like are sequentially arranged around the photosensitive drum 2 along the rotating direction thereof.

A sheet feed deck 11 for enclosing the transfer sheet P is arranged in the lower portion on the inside of the main body 1, namely, under the photosensitive drum 2 on the upstream side in the conveying direction of the transfer sheet P. The transfer sheet P is supplied from the sheet feed deck 11. The transfer sheet P in the sheet feed deck 11 is fed by a sheet feed roller 12 and is supplied to a transfer portion between the photosensitive drum 2 and transfer charging unit 8 through a conveying roller 13 and a regist roller 15. In the transfer portion, the toner image is transferred onto the transfer sheet P from the photosensitive drum 2. After the toner image was transferred, the transfer sheet is conveyed to a fixing unit 17 by a conveying belt 16. The unfixed toner image on the transfer sheet P is fixed by the fixing unit 17. The transfer sheet P is ejected as a final copy onto a sheet ejecting tray 20 by a sheet ejecting roller 19.

In the above copying apparatus, the exposing unit 6 illuminates an original put on a platen glass 21 by an original illuminating lamp 22 and a reflecting plate 23. The reflection light from the original image is further reflected by mirrors 25*a*, 25*b*, and 25*c* and is allowed to pass through an enlarging/reducing lens 26. After that, the light is led to the surface of the photosensitive drum 2 through a projecting mirror 27. Thus, the surface of the photosensitive drum 2 which was charged uniformly is exposed, thereby forming an electrostatic latent image corresponding to the original image.

Figure 2:
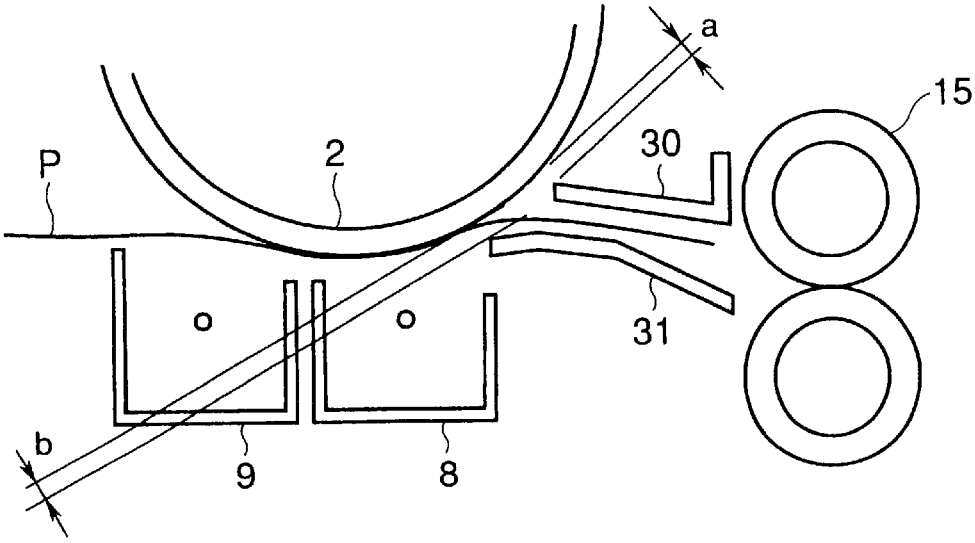
FIG. 2 is a schematic constructional diagram showing a structure near a guide member and a transfer portion existing in the middle of a conveying path of a transfer sheet.

FIG. 2 is a schematic constructional diagram showing component elements near a guide member and a transfer portion existing in the middle of the conveying path of the transfer sheet P. In the diagram, the transfer sheet P which passed through the resist roller 15 is guided along a gap between an upper guide 30 and a lower guide 31 serving as guide members and is inserted to a predetermined proper position (transfer portion) between the photosensitive drum 2 and transfer charging unit 8. The transfer charging unit 8 has a function for emitting charges of a polarity opposite to that of the toner and attracting the toner from the photosensitive drum 2 onto the transfer sheet P. Since the transfer sheet P which received the charges of the transfer charging unit 8 is likely to be adsorbed to the photosensitive drum 2, it is discharged by the separation charging unit 9, so that the transfer sheet is peeled off and fed to the conveying belt 16 (refer to FIG. 1).

In order to insert the transfer sheet P to a predetermined proper position between the photosensitive drum 2 and transfer charging unit 8, the upper guide 30 and lower guide 31 are closely arranged on the upstream side in the transfer sheet conveying direction of the photosensitive drum 2. Actually a distance a between the upper guide 30 and photosensitive drum 2 is set to 2.00 mm±0.50 mm and a distance b between the lower guide 31 and photosensitive drum 2 is set to 1.20 mm±0.25 mm. Unless the upper guide 30 and lower guide 31 are arranged near the photosensitive drum 2, the transfer sheet P is not conveyed to the proper position, so that a defective feed of the transfer sheet P and an image disturbance are caused. "Image disturbance" denotes a state in which when the charges are received from the transfer charging unit 8 in a state in which a gap is formed between the transfer sheet P and photosensitive drum 2, the toner on the photosensitive drum 2 flies in the gap, so that the toner is not transferred to the correct position on the transfer sheet P and the image is disturbed. Especially, the distance b between the lower guide 31 and photosensitive drum 2 needs to be maintained at a relatively high precision.

Figure 3A:
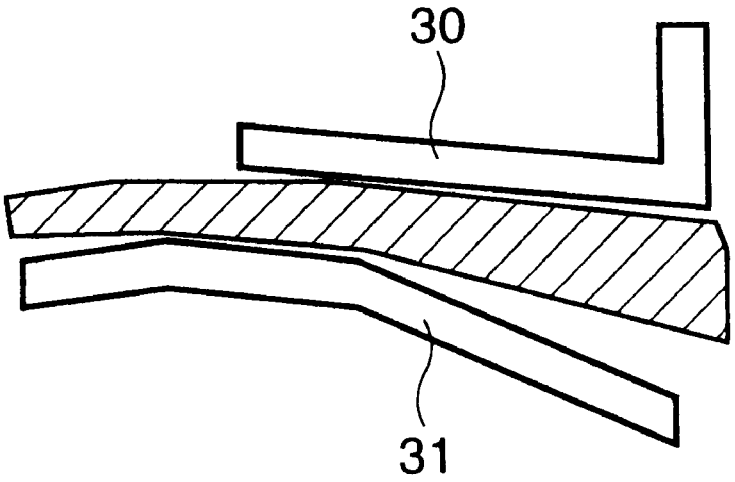

In recent years, there is a tendency such that the number of variety of kinds of transfer sheets P increases. As one tendency, a thick sheet having a weight exceeding 100 g/m$^2$ is used in association with an advancement of a bookbinding technique of a copying apparatus. As a transfer sheet P, such a thick sheet has special characteristics due to a thickness as compared with what is called a normal sheet with a weight less than 100 g/m$^2$ as a transfer sheet P. For example, there are a hardness of the sheet, namely, a stiffness of the sheet and a surface property. It will be obviously understood that the hardness of the sheet is higher as the thickness of sheet increases and the surface property of the thick sheet is generally smooth. As mentioned above, the thick sheet with different characteristics shows a conveying form different from that of the normal sheet. FIG. 3A is a diagram showing the locus of the normal sheet passing between the upper guide 30 and lower guide 31 by a hatched region. Since the hardness of the normal sheet is lower than that of the thick sheet, the normal sheet has characteristics such that although it flutters in a region near the entrance of the guide member, so that a passing range is widened, the passing range is relatively narrowed in a region near the end portion (hereinafter, referred to as an "edge portion") of the guide member. Therefore, there is no friction between the normal sheet and the edge portion of the guide member.

Figure 3B:
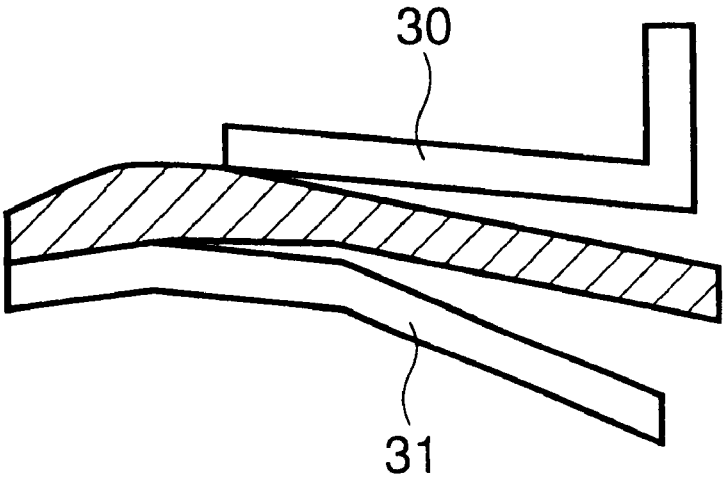

On the other hand, FIG. 3B is a diagram showing the locus of the thick sheet passing between the upper guide 30 and lower guide 31 by the hatched region. Since the thick sheet has a hardness of the sheet, the thick sheet has characteristics such that although a fluttering in the region near the entrance of the guide member is small and the passing range is narrowed, in the edge portion of the guide member, a fluttering occurs at a time point when the rear edge of the sheet passes through the upper guide 30 and the passing range is widened. Consequently, a phenomenon such that the edge portion of the guide member and the thick sheet are abraded occurs.

Figure 4:
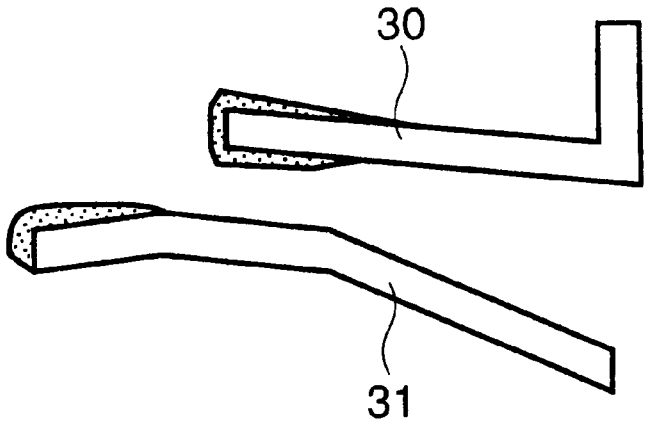
FIG. 4 is a diagram showing a state in which toner is adhered and deposited to a tip portion of the guide member.

Therefore, under a condition such that the toner is deposited onto the guide member, the following problems occur. When the transfer sheet P is always in the same passing region, since the transfer sheet P always carries a contamination of the guide member little by little, the transfer sheet P does not become a state in which the contamination can be confirmed with the eyes. However, as mentioned above, since the normal sheet and the thick sheet have different passing regions, the toner that was adhered to the edge portion of the guide member and cannot be carried in case of the normal sheet is carried by the guide member when it passes on the thick sheet. However, since a use frequency of the thick sheet is generally lower than that of the normal sheet, after the normal sheets passes for a long time, the toner is adhered and deposited to the edge portion between the upper guide 30 and lower guide 31 as shown in FIG. 4. After that, when the thick sheet passes between the space of the guide member, the contamination of the guide member that is proportional to the passing time of the normal sheet is carried by the thick sheet as it is. Thus, an unpleasant contamination is deposited onto the thick sheet.

Figure 5:
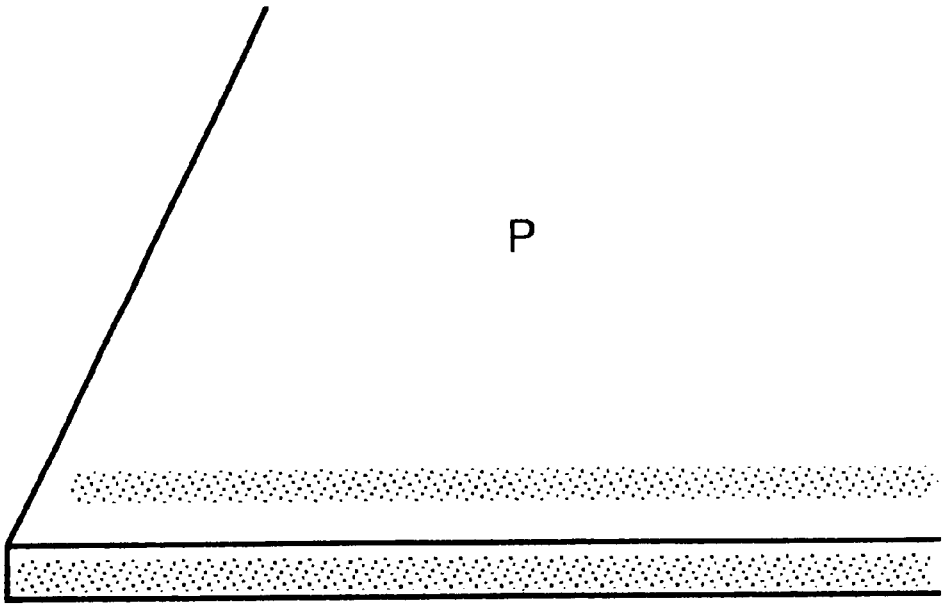
FIG. 5 is a diagram schematically showing a contamination of the thick sheet.

FIG. 5 is a diagram schematically showing a contamination adhered to the thick sheet. The contamination of the guide member makes the rear or front edge of the sheet dirty or makes an edge of the sheet (sheet lumber) dirty. The toner deposited to the upper guide 30 (refer to FIGS. 2, 3A, 3B) becomes a contamination on the front side of the transfer sheet P. The toner deposited to the lower guide (refer to FIGS. 2, 3A, 3B) becomes a contamination on the back side of the transfer sheet P. When a both-side copy is obtained, the front and back sides of the transfer sheet P are reversed and the contamination increases.

Table 1 shows results of experiments about the contamination of the transfer sheet P with respect to comparison examples in which the transfer sheet passes through the conventional guide member and an example in which the transfer sheet passes through the guide member of the embodiment. According to the experiments, an analog exposing type copying apparatus in which a one-component negative toner having an average particle diameter of 8 $\mu$m is used and an a-Si photosensitive drum which is charged to the plus polarity by the primary charging unit is used as an image bearing member. As an evaluating method, a contamination of the thick sheet in the case where after 5000 normal sheets had been allowed to pass, five thick sheets were allowed to pass is ranked by a subjective evaluation. The rank is evaluated at five levels. "5" indicates a state in which there is no contamination and "1" indicates a state in which there is a large contamination.

The experiment results of Table 1 will now be described.

TABLE 1

| | | After 5000 sheets passed | | |
|---|---|---|---|---|
| | Connection and guide potential | Low humidity environment | Normal environment | High humidity environment |
| Comparison example 1 | Ground connection 0 V | 5 | 5 | 5 |

TABLE 1-continued

| | Connection and guide potential | After 5000 sheets passed Low humidity environment | Normal environment | High humidity environment |
|---|---|---|---|---|
| Comparison example 2 | Varistor connection +600 V | 2 | 3 | 4 |
| Comparison example 3 | Insulating connection +1000 V | 1 | 2 | 3 |
| Comparison example 4 | High humidity environment: insulating connection Others: ground connection | 5 | 5 | 3 |
| First embodiment | High humidity environment: varistor connection Others: ground connection | 5 | 5 | 4 |

According to Table 1, the comparison example 1 relates to a case where the guide member is connected to the ground. Although the contamination of the transfer sheet does not occur under the whole environment, the transfer efficiency under the high humidity environment deteriorates and it is not a preferable electric connection. In the ground connection under the high humidity environment, there is a case where the transfer efficiency is below 60%, so that it is not efficient.

The comparison example 2 relates to a case where a varistor serving as a constant voltage element is connected to the guide member in order to prevent a deterioration of the transfer efficiency under the high humidity environment. Although the guide member is charged to the polarity opposite to that of the normal toner and the voltage is stepped up by receiving the transfer current, since the varistor of 600V is connected, the guide member is charged and maintained at 600V. Although there is no problem on the transfer efficiency under the high humidity environment, the contamination of the transfer sheet deteriorates under the low humidity environment. This is because the charged charge amount of the toner increases under the low humidity environment and an electric adsorbing force is enhanced and the toner is easily deposited to the guide member. In other words, the average charge amount within a range from −6 to −8 $\mu$C/g of the toner under the high humidity environment increases to an amount within a range from −13 to −16 $\mu$C/g under the low humidity environment.

The comparison example 3 relates to a case where the guide member is set into an electric insulating state. In the insulating state, an electric potential during the continuous copying operation reaches 1000V or more. The toner is easily adhered to the guide member which was charged to such a high voltage even under the high humidity environment as well as under the low humidity environment. When the a-Si photosensitive material as shown in the experiments is used, the surface potential of the photosensitive drum decreases to 400V at a position of a developing unit even at the highest electric potential and decreases to about 300V at the guide member position due to an attenuation by the elapsed time. Therefore, the toner is attracted by an electric field to the guide member which is arranged at a distance of about 1 to 2 mm from the photosensitive drum and which has an electric potential that is three or more times as high as the surface potential of the photosensitive drum. Since the guide member charged to 1000V or more is not electrically connected, it takes a long time until the guide member is naturally discharged. In case of a trouble such as a jam of transfer sheet, there is a situation such that the user directly touches the sheet, so that it is unpreferable.

The comparison example 4 relates to a case where the guide member is insulated only under the high humidity environment and is connected to the ground under another environment. According to the comparison example 4, a contamination of the guide member occurs under the high humidity environment in a manner similarly to the comparison example 3. In case of switching the insulating state without an electric connection and the ground connection, it is known that the charges accumulated in the insulating state are hard to escape and, when switching to the ground connecting state, a spark discharge occurs and electric noises are generated. Therefore, it is necessary to perform a countermeasure against noises or the like for the other electric parts, resulting in an increase in burden on costs.

In the embodiment, therefore, the varistor is connected under only the high humidity environment, the defective transfer and the contamination of the transfer sheet are prevented, and the guide member is connected to the ground under the other environment, thereby preventing the contamination of the transfer sheet.

Figure 6:
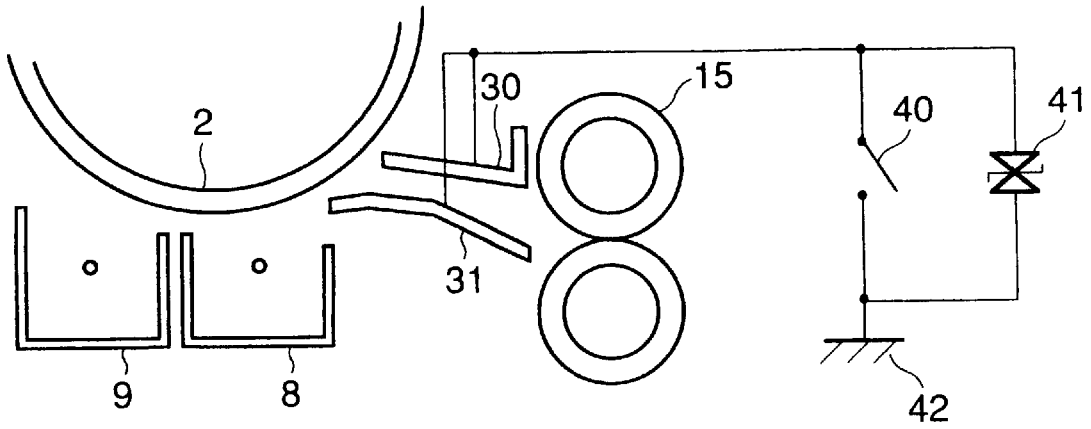
FIG. 6 is a schematic constructional diagram showing a control unit for controlling the guide member in the first embodiment of the invention in accordance with a humidity environment.

FIG. 6 is a schematic constructional diagram showing a control unit for controlling the guide member in the first embodiment of the invention in accordance with the humidity environment. In the diagram, a guide switch (switching means) 40 and a varistor (constant voltage element) 41 are connected in parallel as elements for adjusting the guide potential. When the guide switch 40 is turned on, the upper guide 30 and lower guide 31 are electrically connected to the ground. When the guide switch 40 is turned off, the upper guide 30 and lower guide 31 are connected to the varistor 41 and a varistor set potential is obtained. Since the varistor 41 is the constant voltage element which supplies a current at a charge voltage of 600V or more, it is maintained at +600V of the polarity opposite to that of the normal toner through the lower guide 31 which receives the transfer current. The guide switch 40 is made up of a relay element which is on/off controlled by the control unit (control means), which will be explained hereinlater.

Figure 7:
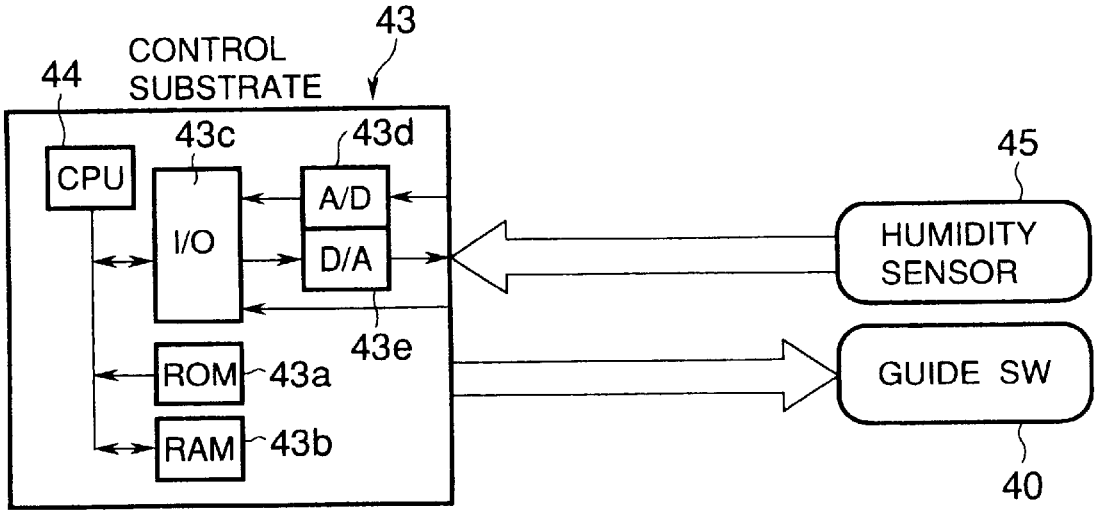
FIG. 7 is an electric block diagram for explaining an outline of the control unit for controlling a guide switch.

FIG. 7 is an electric block diagram for explaining an outline of the control unit for controlling the guide switch 40 in FIG. 6. In the diagram, an ROM 43*a* in which a control program has been stored and an RAM 43*b* serving as a temporary storage device of necessary data on the program are connected to a CPU 44 serving as a center device of processes in a control unit 43. An I/O 43*c* as an interface element and an A/D converter 43*d* and a D/A converter 43*e* serving as data converting elements are connected to an external peripheral equipment. Information is inputted and outputted to/from the control unit 43. A humidity sensor 45 for measuring an environment in the main body is connected to the control unit 43. The on/off operation of the guide switch 40 is controlled in accordance with a detection result from the humidity sensor 45. The humidity sensor 45 is provided for either one of or both of, for instance, a position near the entrance of the guide member and a position in the sheet feed deck 11. A reference value to discriminate a high humidity environment is set to 60%RH or more.

The method wherein guide switch 40 and varistor 41 are connected in parallel and an electric potential of the guide member is switched by the on/off operation by the guide switch 40 has the following effects other than most useful effect of the invention such that both of the good transfer efficiency and the prevention of the contamination of the transfer sheet P are satisfied.

First, since the above effects are obtained by the two elements of the varistor 41 and guide switch 40, a construction is very simple. Since the guide member is always connected to a ground 42 through the varistor 41 (not in an insulating state), in case of a trouble such as a jam of the transfer sheet in which no transfer current is supplied, the guide potential is automatically set to a state equivalent to the ground connecting state. Thus, a process for eliminating the sheet jam at the time of a recovery of the trouble can be easily performed.

By connecting the guide switch 40 and varistor 41 in parallel as mentioned above, a discharge at the time of switching the electric potential of the guide member from +600V to the ground level by the varistor 41 is fairly smaller than a spark discharge from a voltage of 1000V or more. Electric noises can be also extremely reduced. When the transfer current is turned off, the voltage is reduced to a value smaller than +600V after the elapse of a micro time, so that the spark discharge is hard to occur.

<Second embodiment>

The second embodiment will now be described with reference to a timing chart of FIG. 8. Since the embodiment also uses the constructions shown in FIGS. 1, 6, and 7, the same component portions are designated by the same reference numerals and their overlapped descriptions are omitted here.

The embodiment relates to an example in which a change in guide potential due to the environment of the first embodiment is further advanced. That is, according to the embodiment, for instance, only in the case where the humidity sensor 45 detects the high humidity environment, only when the transfer sheet exists at the transfer position, the guide switch 40 is turned off and the guide potential is set to a potential of a polarity opposite to that of the normal toner. In the case where the transfer sheet P such as to deteriorate the transfer efficiency does not exist at a position near the guide member and transfer charging unit 8, the guide switch 40 is turned on, thereby setting the guide potential to the ground potential. Thus, even under the high humidity environment, a better prevention of the contamination of the guide member and a higher transfer efficiency than those in the first embodiment can be derived.

Figure 8:
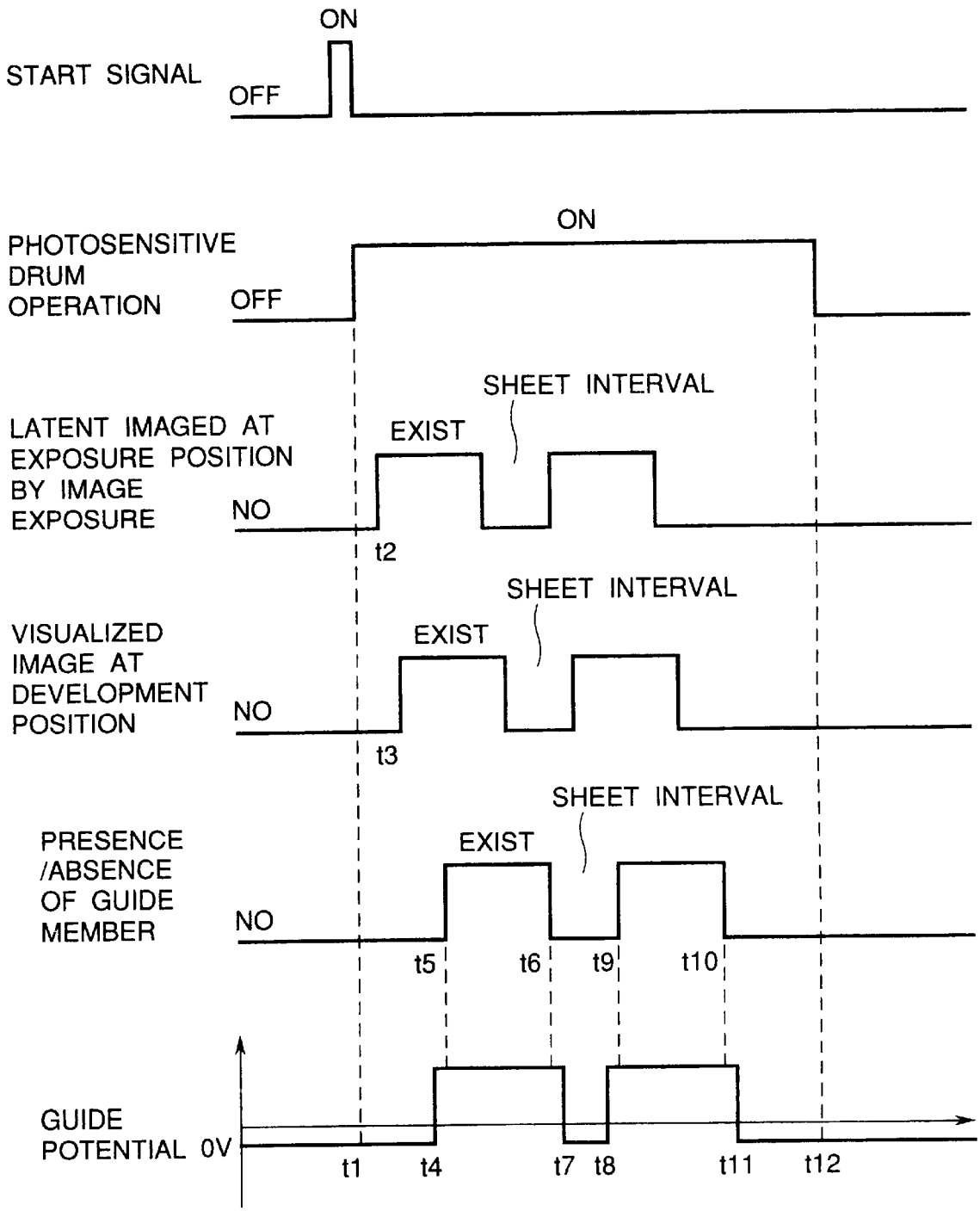
FIG. 8 is a timing chart which shows operating states of main elements for executing a control method and which controls a guide potential according to the second embodiment of the invention.

FIG. 8 is a timing chart which shows operating states of main elements to execute the above control method and is used to control the guide potential. When a copy start signal is turned on by a start button, the photosensitive drum 2 is made operative and the surface on the photosensitive drum 2 is uniformly charged by the primary charging unit 5. Subsequently, an image exposure is started in accordance with original information. The example shows a case where the operation to form a latent image by exposing the image twice is executed with regard to the two-copy mode. For an interval between the image exposing operations of two times, there is a non-exposure period of time as a non-image region corresponding to a sheet interval, thereby preventing that the toner is adhered by the developing unit 7. When the image exposure is performed, the image is visualized by the developing unit 7 with a slight time delay due to the positional relation around the photosensitive drum 2. Further, the transfer sheet P is guided from the sheet feed deck 11 to the guide member with a slight time delay. The toner on the photosensitive drum 2 is transferred by the transfer portion of the transfer charging unit 8.

As for the presence or absence of the transfer sheet P in the guide member, the front edge of the transfer sheet P reaches for a time interval from time t2 when the image exposure is started to time t5 which is delayed by only a time corresponding to a distance between the exposing position and the entrance position of the guide member, and the rear edge of the transfer sheet P passes at time t6. With respect to the second image as well, the front edge of the transfer sheet P reaches at time t9 and the rear edge of the transfer sheet P passes at time t10. Therefore, the guide potential is switched by turning on/off the guide switch 40 at timings before and after the passage of the transfer sheet P. A flying off of the toner from the photosensitive drum 2 on which the toner was adhered can be minimized. The switching timing of the guide potential is set to a surplus time for the presence or absence of the transfer sheet P in the guide member. Such a surplus time is set to 30 msec. (interval between t4–t5, interval between t6–t7, interval between t8–t9, interval between t10–t11).

In the first embodiment, the electric potential of the guide member is stationarily set in accordance with the humidity environment without performing the switching operation of the guide switch 40 during the copying operation. In the embodiment, as shown in FIG. 8, by controlling the contamination of the guide member by the control unit 43 for time intervals among the state before copy (t1–t4), the sheet interval (t7–t8), and the state after the copy (t11–t12) during the operation of the photosensitive drum 2, a good result such that the contamination of the guide member under the high humidity environment is smaller than that in the first embodiment can be obtained. As for the contamination of the lower guide 31, since no toner is adhered at the time of passage of the transfer sheet P, the above construction is an effective preventing measure for the contamination. Table 2 shows a result in which the contamination of the transfer sheet P is ranked as shown in Table 1 in comparison with the first embodiment. The guide member in which there is no contamination of the transfer sheet P even under the whole environment can be provided.

TABLE 2

| | Connection and guide potential | After 5000 sheets passed: Low humidity environment | Normal environment | High humidity environment |
|---|---|---|---|---|
| First embodiment | High humidity environment: varistor connection<br>Others: ground connection | 5 | 5 | 4 |
| Second embodiment | High humidity environment: varistor connection<br>However, only when the transfer material passes.<br>Others: ground connection | 5 | 5 | 5 |

<Third embodiment>

The third embodiment will now be described with reference to FIG. 9.

In the first and second embodiments, in accordance with charging characteristics of the toner, the normal toner showing the main charging characteristics, namely, the toner charged to the minus polarity is not adhered to the guide member if it is, for instance, the negative toner. On the other hand, according to the embodiment, a construction such that the toner which does not have the main charging characteristics (hereinafter, referred to as "unstable charge toner"), for example, the toner of the plus polarity or in which a charged charge amount is electrically small is not adhered to the guide member as well is also commonly provided for the first and second embodiments, thereby further making effective for the contamination of the guide member. The embodiment will now be described hereinbelow.

According to the evaluation when five thick sheets are allowed to pass after 5000 normal sheets were allowed to pass as shown in Tables 1 and 2, it will be understood that the potential setting of the guide member in the first and second embodiments are most effective means. However, when the use for a long period of time further progresses, there is a case where a slight contamination of the guide member is shown. Actually, the contamination of the transfer sheet P after 250,000 sheets passed obviously shows a ore severe result than that in case of passing 5000 sheets as shown in Table 3. It is also shown that according to the potential setting of the guide member according to the prior art, the rank is below Table 3. It has been found out that the cause of the above result is that the unstable charge toner is concerned instead of the normal toner indicative of the main charging characteristics as mentioned above.

TABLE 3

| | Connection and guide potential | After 250,000 sheets passed: Low humidity environment | Normal environment | High humidity environment |
|---|---|---|---|---|
| First embodiment | High humidity environment: varistor connection<br>Others: ground connection | 4 | 4 | 3 |
| Third embodiment | High humidity environment: varistor connection<br>However, only when the transfer material passes.<br>Others: ground connection | 4 | 4 | 4 |

The toner showing the main charging characteristics denotes the toner charged to the minus polarity in case of the negative toner. The unstable charged toner denotes a toner which has a plus polarity or in which a charged charge amount is electrically small. In case of the toner whose average charge amount is equal to −10 $\mu$C/g, the toner in a range from the plus charges to about −3 $\mu$C/g is the unstable charged toner. That is, the unstable charged toner is the toner which is unpreferable in the ordinary developing unit 7 and an electric adsorbing force for the photosensitive drum 2 is weak and such a toner is likely to be peeled off from the photosensitive drum 2. Therefore, the unstable charged toner is likely to fly off and becomes a cause of the contamination of the guide member. Ordinarily, a ratio of the unstable charged toner having the foregoing charge amount is extremely smaller than that of the normal toner showing the main charging characteristics and does not extremely makes the guide member dirty in the use of about 5000 sheets. However, in the use for a long period of time corresponding to 250,000 sheets, the unstable charged toner is gradually deposited, resulting in a deterioration in each rank.

Figure 9:
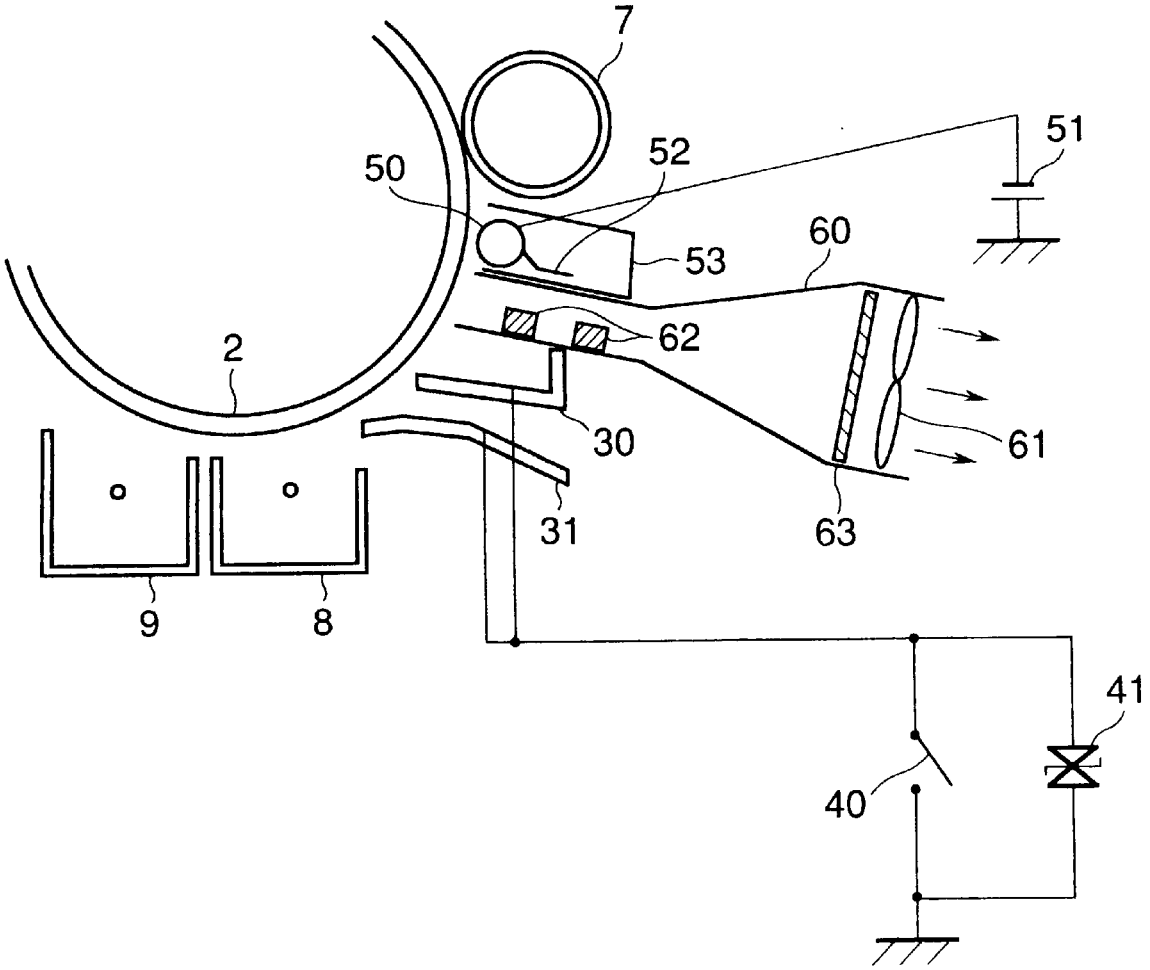
FIG. 9 is a schematic constructional diagram showing unstable charge toner removing means according to the third embodiment.

In the embodiment, therefore, as shown in FIG. 9, unstable charged toner removing means for eliminating the foregoing unstable charged toner is provided on the downstream side of the developing unit 7 and on the upstream side of the guide member, thereby preventing the contamination of the guide member by the unstable charged toner.

FIG. 9 is a schematic constructional diagram showing the unstable charged toner removing means in the embodiment.

In the diagram, two kinds of unstable charged toner removing means are provided between the downstream side of the developing unit 7 to the upper guide 30. That is, a bias roller 50 as first unstable charged toner removing means is provided at a position near the photosensitive drum 2. The bias roller 50 is held to −1000V by a power source 51. The bias roller 50 rotates clockwise and the unstable charged toner is scraped off from the roller 50 by a scraper 52 made of a resin and is collected into a dust collecting chamber 53. The bias roller 50 and photosensitive drum 2 are arranged at a distance of 1.8 mm and are used to collect the inverted toner which was mainly scattered from the developing unit 7 and exists around the photosensitive drum 2 and was charged to the plus polarity. The toner near the photosensitive drum 2 is sucked by an air duct 60 and a suction fan 61 serving as second unstable charged toner removing means and is collected to a collecting magnet 62 and a collecting filter 63.

The bias roller 50 is means for collecting the toner charged to the plus polarity which is not the main component of the toner. The air duct 60 is means for collecting the toner whose charged charge amount is small.

The unstable charged toner (scattered toner) which is adhered onto the photosensitive drum 2 in a state of a weak electric adsorbing force or is floating is unpreferable for the developing unit 7. When the second unstable charged toner removing means in the embodiment is not provided, the unstable charged toner makes the guide member dirty by the use for a long period of time as shown in Table 3. Therefore, by commonly using the embodiment together with the first and second embodiments, any toner is hard to be adhered to the guide member, so that a construction around the guide member and transfer charging unit 8 without a contamination by the toner can be formed.

Table 4 shows a comparison of the case of commonly using the embodiment together with the second embodiment and the case of the second embodiment. Table 4 shows the result of ranking the contamination of the transfer sheet P after 250,000 sheets were allowed to pass in a manner similar to Table 3. By commonly using both of the embodiment and the second embodiment, the guide member which does not make the transfer sheet P dirty even by the use for a long period of time can be provided.

As means for collecting the toner having the unpreferable electric characteristics as second unstable charged toner removing means in the embodiment, there is a magnetic attraction, a dust collecting duct, or a roller arranged near the image bearing member having the reverse polarity potential.

In all of the above embodiments, in place of detecting the humidity, a temperature can be also detected in order to detect the environment. More preferably, the temperature and humidity are detected and whether the guide member is connected to the constant voltage element or is connected to the ground can be also determined in accordance with an absolute moisture quantity in the air. That is, it is also possible to construct in a manner such that when the absolute moisture quantity is equal to or larger than a predetermined value, the guide member is connected to the constant voltage element and, when the absolute moisture quantity is smaller than the predetermined value, the guide member is connected to the ground.

What is claimed is:

1. An image forming apparatus comprising:

an image bearing member for bearing a toner image;

transfer charging means for transferring the toner image from said image bearing member to a transfer material at a transfer position;

a guide member for guiding the transfer material to the transfer position;

a constant voltage element for generating a voltage by receiving a transfer electric current flowing in said guide member via the transfer material from said transfer charging means; and switching means for switching whether said constant voltage element is inserted between said guide member and ground.

2. An image forming apparatus according to claim 1, further comprising detecting means for detecting an ambient environment of said image forming apparatus.

3. An image forming apparatus according to claim 2, wherein said detecting means detects humidity.

4. An image forming apparatus according to claim 3, wherein when the humidity detected by said detecting means is equal to or higher than a predetermined value, said guide member is connected to said constant voltage element, and when said humidity is smaller than the predetermined value, said guide member is connected to ground.

TABLE 4

| | | After 250,000 sheets passed | | |
|---|---|---|---|---|
| | Connection and guide potential | Low humidity environment | Normal environment | High humidity environment |
| Second embodiment | High humidity environment: varistor connection However, only when the transfer material passes. Others: ground connection | 4 | 4 | 4 |
| Second embodinent plus unstable charged toner removing means | High humidity environrnent: varistor connection However, only when the transfer material passes. Others: ground connection | 5 | 5 | 5 |

5. An image forming apparatus according to claim 4, wherein when said guide member does not guide the transfer material, said guide member is connected to ground irrespective of the humidity detected by said detecting means.

6. An image forming apparatus according to claim 2, wherein said detecting means detects temperature.

7. An image forming apparatus according to claim 2, wherein when said guide member does not guide the transfer material, said guide member is connected to ground irrespective of a detection result of said detecting means.

8. An image forming apparatus according to claim 2, further comprising developing means for developing an electrostatic image formed on said image bearing member by toner.

* * * * *

UNITED STATES PATENT AND TRADEMARK OFFICE

CERTIFICATE OF CORRECTION

PATENT NO. : 6,125,244

DATED : September 26, 2000

INVENTOR(S): YUJI KAMIYA

It is certified that error appears in the above-identified patent and that said Letters Patent is hereby corrected as shown below:

[57] ABSTRACT:

Line 1, "of" should be deleted.

COLUMN 2:

Line 38, "prefered" should read --not preferred--.

COLUMN 6:

Line 14, "passes" should read --pass--.

COLUMN 11:

Line 62, "ore" should read --more--.

COLUMN 12:

Line 52, "makes" should read --make--.

UNITED STATES PATENT AND TRADEMARK OFFICE

CERTIFICATE OF CORRECTION

PATENT NO. : 6,125,244

DATED : September 26, 2000

INVENTOR(S): YUJI KAMIYA

It is certified that error appears in the above-identified patent and that said Letters Patent is hereby corrected as shown below:

COLUMN 15:

Line 7, "claim 2," should read --claim 1,--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*